US006928803B2

(12) United States Patent
Stalder et al.

(10) Patent No.: US 6,928,803 B2
(45) Date of Patent: Aug. 16, 2005

(54) TEXTILE PROCESSING MACHINE WITH A FIBER CONVEYING CHANNEL AND A FIBER-GUIDING SURFACE

(75) Inventors: Herbert Stalder, Kollbrunn (CH); Peter Anderegg, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 10/364,297

(22) Filed: Feb. 11, 2003

(65) Prior Publication Data

US 2003/0177751 A1 Sep. 25, 2003

(30) Foreign Application Priority Data

Feb. 12, 2002 (CH) ..... 0235/02

(51) Int. Cl.[7] ..... D01H 4/02

(52) U.S. Cl. ..... 57/350; 57/400; 57/328; 57/333

(58) Field of Search ..... 57/315, 328, 333, 57/350, 433, 403

(56) References Cited

U.S. PATENT DOCUMENTS 5,193,335 A 3/1993 Mori
5,263,310 A * 11/1993 Mori ..... 57/328
5,390,485 A * 2/1995 Mori ..... 57/328
5,528,895 A 6/1996 Deno
5,927,062 A 7/1999 Deno et al.
2003/0121247 A1 * 7/2003 Stalder et al. ..... 57/333

FOREIGN PATENT DOCUMENTS

DE 3810860 A1 11/1988
JP 3106368 2/1990
JP 04024221 A * 1/1992 ..... D01H/1/115
WO 0224993 A2 3/2002
WO 0224993 3/2002

OTHER PUBLICATIONS

EPO Search Report, filed Nov. 27, 2003.

* cited by examiner

*Primary Examiner*—John J. Calvert
*Assistant Examiner*—Shaun R Hurley
(74) *Attorney, Agent, or Firm*—Dority & Manning, P.A.

(57) ABSTRACT

The invention relates to a device for the production of a spun thread from a staple fiber strand by means of air spin method. The fiber guiding element according to the invention includes a fiber conveying channel with a fiber guiding surface, whereby the fiber guiding surface ends at a fiber presenting edge and leads the fibers of the staple strand in the form of an essentially flat arrangement lying next to each other. The fiber-guiding surface is configured in such a manner that it includes a diverting point which causes a deviation of the staple fiber strand, where the deviation is being provided in such a manner that the free fiber ends of the fibers within the staple fiber protrude from the staple fiber strand.

13 Claims, 3 Drawing Sheets

Prior Art

Prior Art

I-I

II-II

TEXTILE PROCESSING MACHINE WITH A FIBER CONVEYING CHANNEL AND A FIBER-GUIDING SURFACE

FIELD OF THE INVENTION

The present invention relates to a device for the production of a spun thread from a staple fibre strand, the device including a fibre conveying channel with a fiber guiding surface that ends at a fiber presenting edge.

STATE OF THE ART

Such devices are known in the textile technology and are applied in air spinning methods. Such a device is disclosed for example in EP 854 214 (equivalent to U.S. Pat. No. 5,927,062), which is shown in FIG. 1. One can recognize how a staple fibre strand 1 is supplied from a pair of discharge rollers 2 (usually a drafting unit) and passes through a fibre-guiding element 3. The fibre-guiding element 3 comprises a fibre-conveying channel 4 with a helix type fibre-guiding surface 5. The staple fibre strand 1 is led by way of the fibre-guiding surface 5, whereby the fibre-guiding surface ends at a fibre presenting edge 6. At a certain distance to the fibre-guiding element 3, and/or to the fibre presenting edge 6, there is a spindle 7 with a yarn-guiding channel 8, and an inlet opening 9 pertaining to the yarn-guiding channel 8 is provided. Between the fibre-guiding element 3 and the inlet opening 9, a fluid device is provided for the generation of turbulence around the inlet opening 9 (this fluid device is not shown). The fluid device generates turbulence 11 around the inlet opening 9, and/or around the spindle 7. By means of the generated turbulence 11, the free fibre ends 12 of the staple fibre strand 1 are laid around the inlet opening 9. Due to the movement of the fibre strand 1 in the direction of the arrow, a relative rotary movement of the free fibre ends 12 around the inlet opening 9 results and thus around the fibre strand 1. From the staple fibre strand 1 thus results in a spun thread 10.

The present invention is concerned with the configuration of fibre guiding elements, as is shown by the FIG. 1. The invention relates in particular to the configuration of fibre conveying channels and the pertaining fibre guiding surfaces.

A further state of the art according to the Japanese disclosure JP 3-10 63 68 is shown in the FIGS. 2 and 2*a*. In FIG. 2, essentially the same components are shown as in FIG. 1 (with one change, see FIG. 2*a*). In particular, the pair of discharge rollers 2 and the spindle 7 with the yarn-guiding channel 8 can be recognized. Similarly to FIG. 1, a fluid device 13 is also shown here for the generation of turbulence. The fluid device 13 consists of several holes, from which a fluid (preferably air) is injected into the space 14 under pressure. The injected compressed air generates turbulence around the inlet opening 9 of the spindle 7. As can be recognized, the fibre guiding element 3*a* consists of two components.

In FIG. 2*a*, the fibre-guiding element—part 3*b* of the FIG. 2—is shown in a three-dimensional view. In contrast to FIG. 1, the part 3*b* of the fibre-guiding element does not comprise a helical-shaped, but a plane fibre-guiding surface 15. A further difference to FIG. 1 lies in the absence of a fibre presenting edge. In place of the fibre presenting edge, the fibre-guiding element, part 3*b*, comprises a blunt (frusto) cone 16. The purpose of this cone 16 is to produce a so-called false thread core. This is to prevent that a false twist (twisting of the staple fibre strand) extends from the inlet opening 9 backwards through the fibre-guiding element 3 up to the clamping gap of the pair of outlet rollers 2. A false twist prevents a real rotation and/or twisting of the free fibre ends 12 for the formation of a thread, because the core of the staple fibre strand rotates together with the free fibre ends 12. That means, the false twist would prevent a spinning of the fibres. With the state of the art according to FIG. 1, it is intended to realize the twist stop by means of the helix type fibre guiding surface 5, which is to prevent twisting of the staple fibre strand 1 towards the discharge rollers 2.

A further state of the art relating to the device according to the invention is found in a further patent application of the assignee of the present application (international application number: PCT/CH 01-00569) corresponding to U.S. Patent Publication No.: 2004/0025488A1. The content of U.S. Patent Publication No.: 2004/0025488A1 (that is, the description including claims and drawings) are to be regarded as an integral part of this present application and are incorporated herein by reference for all purposes.

The known state of the art of the FIGS. 1 and 2 comprises various disadvantages which are sought to be eliminated and/or minimized with the device according to the invention. A disadvantage of the devices shown in the FIGS. 1, 2, and 2*a* consists, for example, of the fact that the guiding of the fibres in the fibre guiding element 3 and/or 3*a* is undefined and that the functioning of the twist stop is not accomplished perfectly in all conditions. A further disadvantage is that the twist stop shown in the figures can hinder an optimal guidance of the fibre. A further critical point which has not yet been solved satisfactorily in all applications, published or unpublished, mentioned so far, is the guidance of the fibre strand between the clamping line of the pair of discharge rollers and the fibre guiding element (see for example FIG. 1 or 2). The staple fibre strand, which consists of individual parallelized and non-twisted fibres, has a relatively low strength and/or a relatively low internal adherence. Due to the (relatively high) rotational speeds of the pair of discharge rollers, air flows result in the wedge-shaped space between the clamping line and the fibre-guiding element and can disturb the flow of the staple fibre strand. This influence can thereby not only lead to tearing-off of the staple fibre strand, but actually also affect the guiding of the fibre and with it exert a negative effect on the thread quality.

SUMMARY OF THE INVENTION

The task as an object of the present invention is accordingly to eliminate or minimize the disadvantages of the state of the art. The guiding of the fibre should be configured in particular in such a manner that the thread quality of the spun thread is improved. Additional objects and advantages of the invention will be set forth in the following description, or may be obvious from the description, or may be learned through practice of the invention.

The task is solved by the characteristic features according to the invention wherein the fiber guiding surface leads the fibres of the staple fibre strand in the form of an essentially flat arrangement lying next to each other. The fibre guiding surface comprises a diverting point which causes a deviation of the staple fibre strand, whereby the deviation is of such a manner that the free fibre ends of the fibres within the staple fibre strand protrude from said staple fibre strand.

Further favourable embodiments of the invention are specified in the dependent claims.

The invention and the inventive idea are now described in several exemplified embodiments by way of figures, whereby the invention and the inventive ideas are not limited to the embodiments shown in the examples. Thus, the claimed invention is not limited to the exemplified embodiments. The exemplified embodiments are to be understood rather as a challenge for the specialist to find further embodiments for the invention.

BRIEF DESCRIPTION OF THE FIGURES

FIG. 4 A cross section of the device according to the invention according to FIG. 3 with a staple fibre strand and a spun thread;

FIG. 4*a* A cross section along the section lines I—I of FIG. 4;

FIGS. 5 and 5*a* A further embodiment of the invention with a circle-shaped cavity of the fibre presenting edge;

FIG. 5*b* A further cross-section along the section lines III—III of FIG. 5;

FIGS. 6*a*, 6*b* Further embodiments of the invention with different front surfaces;

FIG. 6*c* A further embodiment of the invention according to FIG. 3.

DETAILED DESCRIPTION

Figure 1:
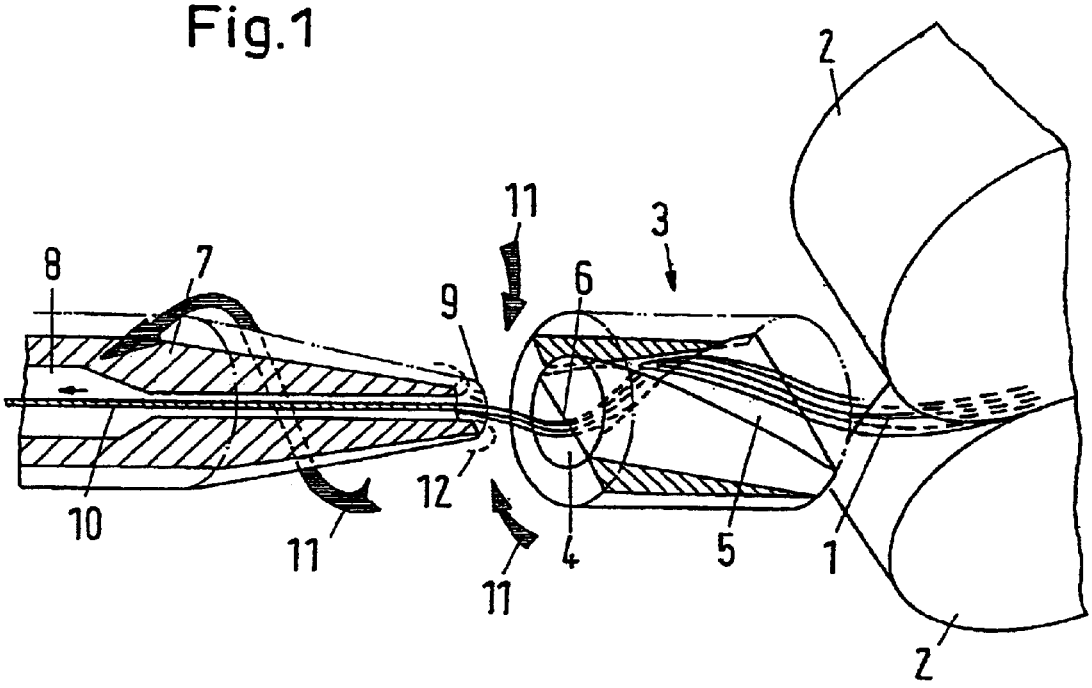
FIG. 1 State of the art according to the disclosure of EP 854 214.
Figure 2:
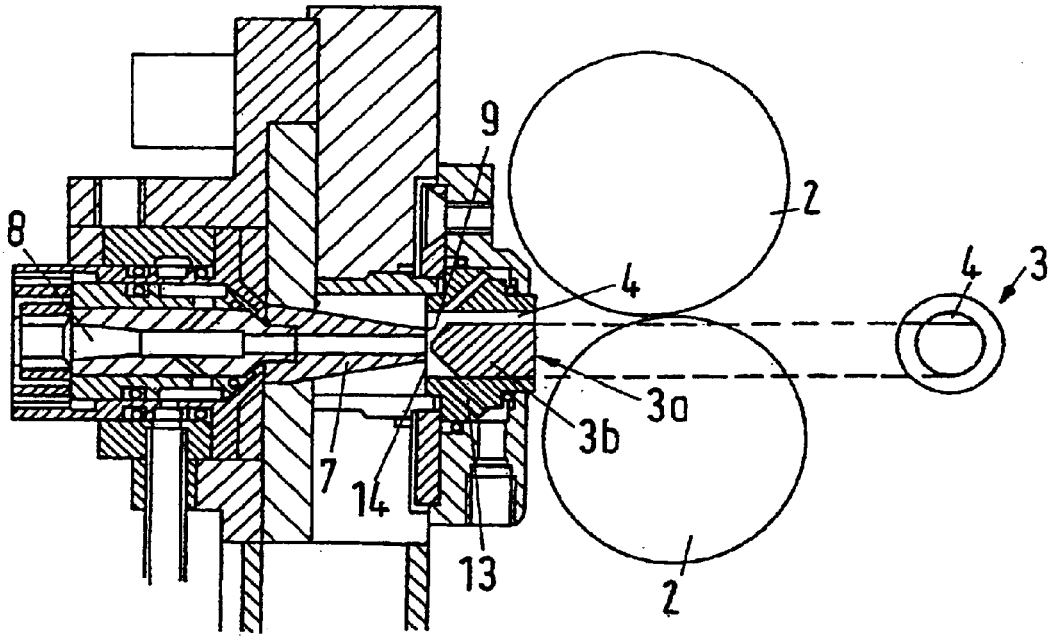
FIGS. 2 and 2*a* State of the art according to the JP 3-10 63 68.
Figure 2A:
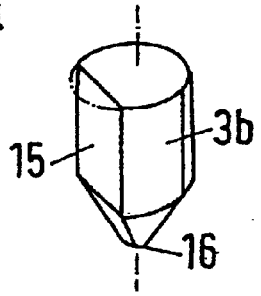
Prior Art Fig.2a
Figures 3, 3A, 3B, 3C, 3D, 3E:
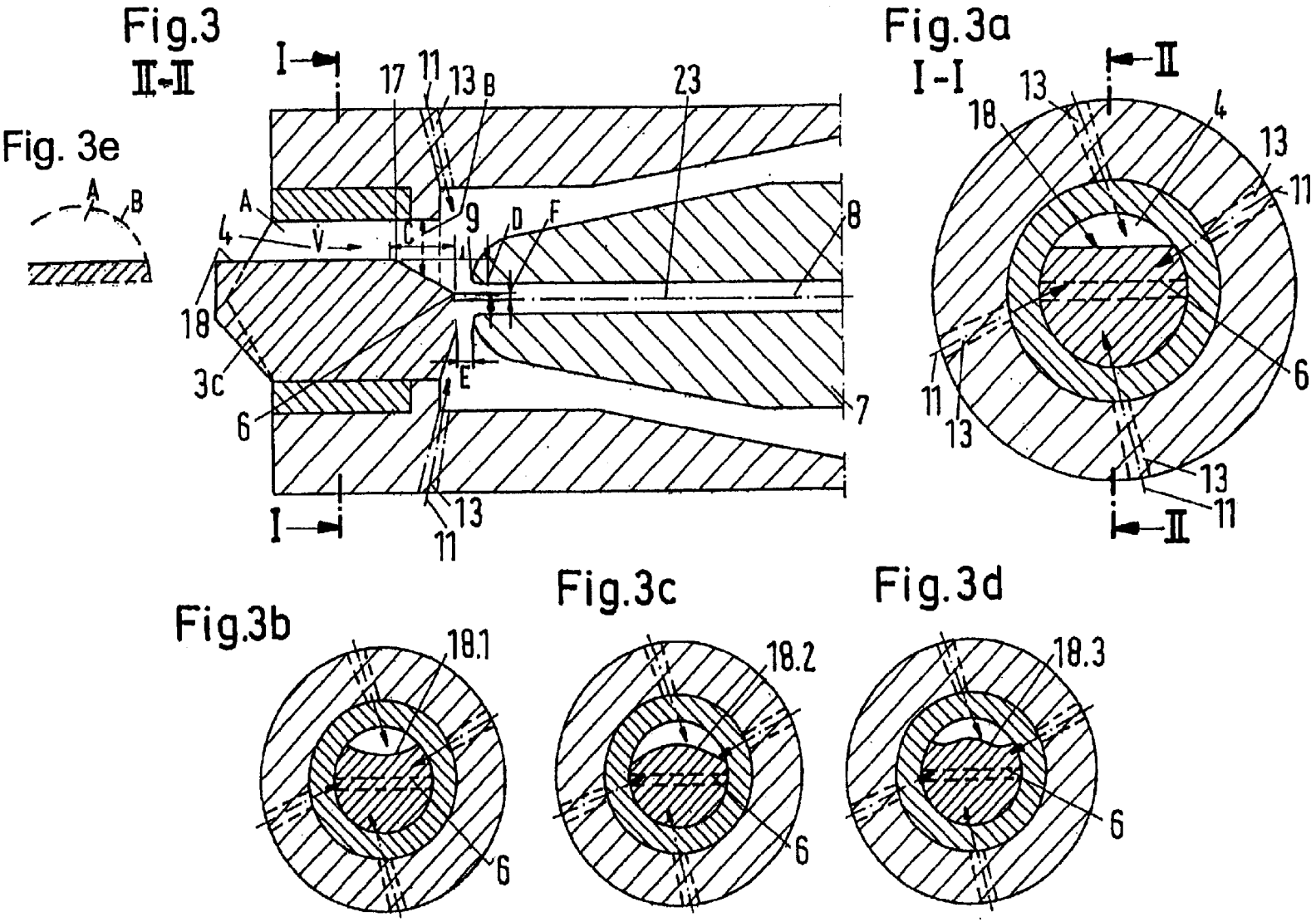
FIG. 3 A possible embodiment of the invention according to the section lines II—II of FIG. 3*a;*
FIG. 3*a* A section along the section lines I—I of FIG. 3.
FIGS. 3*b*, 3*c*, 3*d* Various embodiments for the configuration of the fibre guiding surface according to the cross section of FIG. 3*a;*
FIG. 3*e* A cross-section of the fibre conveying channel according to FIG. 3.

The invention and its mode of operation are now being described by way of FIG. 3. The figure shows a device for the production of a spun thread with a fibre guiding element 3*c* configured according to the invention, a fluid device 13 for the generation of turbulence 11 around the inlet opening 9 of a spindle 7 with integrated yarn guiding channel 8. FIG. 3 shows a cross section of the device parallel to the conveying direction of the staple fibre strand (not shown in this figure). The fibre guiding element 3*c* shown in the figure comprises a fibre-guiding surface 18 with a diverting point 17 according to the invention. The diverting point 17 is formed in this example with the configuration of the fibre-guiding surface 18 according to the invention. As can be seen from the figure, the fibre-guiding surface 18 actually consists of two plane surfaces whose common intersection line forms the diverting point 17. By this configuration of the fibre-guiding surface, the fibres of the staple fibre strand are led essentially in an arrangement where they are laying flat next to each other. A contribution to this flat arrangement is also supplied by the fibre presenting edge 6. The diverting point 17 (which is here formed as supplemental edge) is dimensioned in such a way that the fibres of the staple fibre strand are diverted in such a manner that the free fibre ends of the fibres, which are within the staple fibre strand, can project from said strand (see FIG. 4). At the diverting point 17, the front as well as the back fibre ends are lifted upward, above all those fibres, which are on or directly below the surface of the staple fibre strand. At the diverting point 17, both the front as well as the back fibre ends are lifted up. By the upward projection of the fibre ends at the diverting point 17, the number of free fibre ends in the staple fibre strand increases. As "free fibre ends" we refer to those ends which do not lie within the strand of the staple fibres or which are not connected with other fibres and thus cannot be caught by the turbulence. With the increase of the number of free fiber ends, the number of fibres being wound (wrapped) around in the thread increases, as well as the quality of the spinning process. As a whole, the thread quality can thereby be increased. It is therefore essential to configure the diverting point in such a manner that the effect of the up lifting of the free fibre ends is achieved according to the invention. The international application PCT-CH 01-00569 corresponding to U.S. Patent Publication No.: 2004/0025488A1 of the assignee shows in its figures and describes in its disclosure an elevation of its fibre-guiding surface. This elevation serves, however, not the purpose of the invention, but is for the loosening of possible dirt particles within the fibre strand, so that a conveying air flow can seize and remove these particles more easily. As one can see from the figures of this application, the "elevation" is neither suitable nor meant for the up-lifting of the free fibre ends of the fibres within the staple fibre strand, and thus to cause the effect according to the invention.

The configuration according to the invention of the fibre-guiding surface has surprisingly a further advantage in relation to the state of the art. The reduction of the cross section A of the fibre-conveying channel 4 within a section resulted in that the air volume V flowing through was surprisingly increased. Thus, with the increased airflow V, the fibre guidance between the discharge rollers and the inlet of the fibre guiding element 3*c*, that is the guidance before the fibre-guiding element, could be improved substantially. The number of production interruptions, caused through tearing of the staple fibre strand immediately after the discharge rollers, could be reduced. Likewise, a measurable improvement of the thread quality could be realized. Tests showed that particularly good results are achieved if the cross section A of the fibre conveying channel 4 remains constant up to the diverting point 17, and starting from the diverting point or supplemental edge 17, the following cross section B of the fibre conveying channel increases (see FIG. 3*e*).

The cross sections A of the fibre conveying channel, up to the diverting point, preferably amounts to 0.5 up to 10 $mm^2$, preferably from 2 up to 5 $mm^2$. The supplemental or traverse, edge 17 is disposed at a given horizontal distance C from the fibre presenting edge 6. The distance C may have a dimension of 1 mm to 4 mm, preferably 1.5 mm to 2.5 mm. Also, the supplemental or traverse, edge 17 is disposed at a given vertical distance D from the fibre presenting edge 6, whereby the distance D amounts to 0.2 mm to 1 mm, preferably 0.4 mm to 0.7 mm. Further, the fibre presenting edge 6, 6.1 is disposed at a given horizontal distance E from the inlet opening 9. The distance E can measure 0.1 mm to 1 mm, preferably 0.3 mm to 0.7 mm. The presenting edge 6 is also disposed at a given vertical distance F from the centered line axis 23 of the yarn guiding channel 8. The distance F can measure 10% to 40% of the diameter of the yarn guiding channel 8.

FIG. 3*a* shows a cross section along the lines I—I of the device in FIG. 3 according to the invention. Particularly well recognizable is the plane fibre guiding surface 18 and the fibre presenting edge 6 according to the invention. As can be seen in FIGS. 3*b*, 3*c* and 3*d* it can be of advantage, if the fibre-guiding surface according to the invention comprises a convex, concave or waved surface. This deviation from the basically optimal form of the plane surface is particularly recommendable in those cases where the staple fibre strand comprises "sticky" or "slippery" fibres. The embodiment according to FIG. 3*b* with the concave fibre-guiding surface 18.1 is particularly suitable for "slippery" fibres which comprise a weak, mutual adhesion. A convex embodiment according to the invention of the fibre-guiding surface 18.2 can be suitable for "sticky" fibres which have a stronger mutual adhesion (the adhesion of the fibres is loosened, whereby more free fibre ends can result). FIG. 3*d* shows a wavy fibre guiding surface 18.3. This can help to obtain a flatter arrangement of fibres in the staple fibre strand. FIG. 3*e* has already been explained; it shows how the cross section B of the fibre-conveying channel, after the diverting point (outline shown in broken line), is enlarged by the crosshatched surface.

FIG. 4 shows the same exemplified embodiment of the invention as FIG. 3. Additionally the staple fibre strand 20 can be seen here. In this figure, one of the effects of this invention can clearly be recognized: At the diverting point 17, the free fibre ends 19 of the fibres in the staple fibre strand 20 can lift-off (exemplarily illustrated). One recognizes that the free fibre ends 19 comprise both front and back fibre ends (correspondingly on the left or on the right side of the diverting point 17). One can recognize how the staple fibre strand 20 comprises more free fibre ends after passing the diverting point 17. These free fibre ends can be caught better by the turbulence 11 and be laid around the inlet opening 9. This way more free fibre ends can be spun and/or more wrapping fibres be generated, which actually improves the spinning process. FIG. 4*a* shows a cross section along section lines I—I of the FIG. 4. It can be recognized, how the staple fibre strand 20 possesses a flat arrangement.

The following figures show different embodiments of the fibre presenting edge 6 and of the front surface 21. FIG. 5 shows a further embodiment of the invention, whereby the fibre-guiding surface 22 comprises a cylindric trough-shaped cavity (fibre guiding surface before the diverting point 17 is plane). The trough-shape of the fibre-guiding surface 22 results in a concave fibre presenting edge 6.1. The front surface 21 of the fibre presenting edge 6.1 is also shown. As one can also see in the further FIGS. 5*a* and 5*b* (illustrations of cross section of FIG. 5) in this exemplified embodiment of the invention, the front surface 21 is essentially vertical to the fibre presenting edge 6.1 and/or to the yarn-guiding channel 8.

The front surface can, however, comprise other shapes. As is shown in FIG. 6*a*, the front surface 21 can be vertical with a straight presenting edge 6. But it can, however, also comprise a convex form (21.1) as is shown in FIG. 6*b*, or, as in FIG. 6*c*, comprise a concave shape (21.1). In FIGS. 6*b* and 6*c* embodiments are also shown where the fibre presenting edge 6 and the front face 21 do not possess the full width of the fibre guiding element 3*c*. According to the invention, the width of the fibre guiding element 3*c*, close to the fluid device 13, can converge conically, so that the fibre presenting edge 6 and the front surface (22.2), and/or 22.2, comprise only the width G (compare with FIG. 6*a*).

The invention is not explicitly limited to the specified possibilities and embodiments. These embodiments are rather meant as suggestions for the specialist to convert the invention idea as favourably as possible. With the described embodiments, thus further favourable applications and combinations are easily derivable, which likewise reflect the inventive idea and which are to be protected by this application. Some features revealed in the description are claimed as combinations in the following claims. It would, however, also be conceivable to claim individual features of the description alone for themselves or in another combination. The invention is in particular suitable in specific devices for air spinning. To be protected is in particular the fibre-guiding device according to the invention.

What is claimed is:

1. A device for producing a spun thread from a strand of staple fibers, comprising:

a spindle having a yarn guiding channel defined therethrough and an inlet opening to said yarn guiding channel;

a fluid device disposed relative to said inlet so as to generate a fluid turbulence around said inlet opening;

a fiber guiding element disposed so as to deliver the strand of staple fibers to said inlet opening, said fiber guiding element comprising a fiber conveying channel with a bottom fiber guiding surface along which the staple fibers of the fiber strand are conveyed in a generally flat adjacent arrangement to a presenting edge of said fiber conveying channel at an end of said fiber guiding surface; and wherein said fiber guiding surface extends along a first plane to a diverting point, and from said diverting point to said presenting edge, said fiber guiding surface extends at a downward angle towards said inlet opening such that free ends of the staple fibers conveyed in the flat arrangement along said fiber guiding surface are caused to protrude as a result of the deviation in said fiber guiding surface.

2. A device for producing a spun thread from a strand of staple fibers, comprising:

a spindle having a yarn guiding channel defined therethrough and an inlet opening to said yarn guiding channel;

a fluid device disposed relative to said inlet so as to generate a fluid turbulence around said inlet opening;

a fiber guiding element disposed so as to deliver the strand of staple fibers to said inlet opening, said fiber guiding element comprising a fiber conveying channel with a bottom fiber guiding surface along which the staple fibers of the fiber strand are conveyed in a generally flat adjacent arrangement to a presenting edge of said fiber conveying channel;

wherein said fiber guiding surface extends along a first plane to a diverting point, and from said diverting point to said presenting edge, said fiber guiding surface extends at a downward angle towards said inlet opening such that free ends of the staple fibers conveyed in the flat arrangement along said fiber guiding surface are caused to protrude as a result of the deviation in said fiber guiding surface; and wherein said fiber conveying channel comprises a generally constant cross-sectional shape up to said diverting point, said cross-sectional shape increasing from said diverting point to said presenting edge.

3. The device as in claim 2, wherein said fiber conveying channel comprises a generally constant cross-sectional area up to said diverting point of between about 0.5 $mm^2$ to about 10 $mm^2$.

4. The device as in claim 1, wherein said diverting point is defined by a transverse edge of said fiber conveying surface extending across said fiber conveying channel.

5. A device for producing a spun thread from a strand of staple fibers, comprising:

a spindle having a yarn guiding channel defined therethrough and an inlet opening to said yarn guiding channel;

a fluid device disposed relative to said inlet so as to generate a fluid turbulence around said inlet opening;

a fiber guiding element disposed so as to deliver the strand of staple fibers to said inlet opening, said fiber guiding element comprising a fiber conveying channel with a bottom fiber guiding surface along which the staple fibers of the fiber strand are conveyed in a generally flat adjacent arrangement to a presenting edge of said fiber conveying channel;

wherein said fiber guiding surface extends along a first plane to a diverting point, and from said diverting point to said presenting edge, said fiber guiding surface extends at a downward angle towards said inlet opening such that free ends of the staple fibers conveyed in the flat arrangement along said fiber guiding surface are caused to protrude as a result of the deviation in said fiber guiding surface;

wherein said diverting point is defined by a transverse edge of said fiber conveying surface extending across said fiber conveying channel; and wherein said transverse edge at said diverting point is disposed at a horizontal distance of between about 1 mm to about 4 mm from said presenting edge.

6. A device for producing a spun thread from a strand of staple fibers, comprising:

a spindle having a yarn guiding channel defined therethrough and an inlet opening to said yarn guiding channel;

a fluid device disposed relative to said inlet so as to generate a fluid turbulence around said inlet opening;

a fiber guiding element disposed so as to deliver the strand of staple fibers to said inlet opening, said fiber guiding element comprising a fiber conveying channel with a bottom fiber guiding surface along which the staple fibers of the fiber strand are conveyed in a generally flat adjacent arrangement to a presenting edge of said fiber conveying channel;

wherein said fiber guiding surface extends along a first plane to a diverting point, and from said diverting point to said presenting edge, said fiber guiding surface extends at a downward angle towards said inlet opening such that free ends of the staple fibers conveyed in the flat arrangement along said fiber guiding surface are caused to protrude as a result of the deviation in said fiber guiding surface;

wherein said diverting point is defined by a transverse edge of said fiber conveying surface extending across said fiber conveying channel; and wherein said transverse edge at said diverting point is disposed at a vertical distance of about 0.2 mm to about 1.0 mm from said presenting edge.

7. The device as in claim 4, wherein said transverse edge at said diverting point is generally straight across said fiber conveying channel.

8. A device for producing a spun thread from a strand of staple fibers, comprising:

a spindle having a yarn guiding channel defined therethrough and an inlet opening to said yarn guiding channel;

a fluid device disposed relative to said Inlet so as to generate a fluid turbulence around said inlet opening;

a fiber guiding element disposed so as to deliver the strand of staple fibers to said inlet opening, said fiber guiding element comprising a fiber conveying channel with a bottom fiber guiding surface along which the staple fibers of the fiber strand are conveyed in a generally flat adjacent arrangement to a presenting edge of said fiber conveying channel;

wherein said fiber guiding surface extends along a first plane to a diverting point, and from said diverting point to said presenting edge, said fiber guiding surface extends at a downward angle towards said inlet opening such that free ends of the staple fibers conveyed in the flat arrangement along said fiber guiding surface are caused to protrude as a result of the deviation in said fiber guiding surface;

wherein said diverting point is defined by a transverse edge of said fiber conveying surface extending across said fiber conveying channel; and wherein said transverse edge at said diverting point is generally curved across said fiber conveying channel.

9. A device for producing a spun thread from a strand of staple fibers, comprising:

a spindle having a yarn guiding channel defined therethrough and an inlet opening to said yarn guiding channel;

a fluid device disposed relative to said inlet so as to generate a fluid turbulence around said inlet opening:

a fiber guiding element disposed so as to deliver the strand of staple fibers to said inlet opening, said fiber guiding element comprising a fiber conveying channel with a bottom fiber guiding surface along which the staple fibers of the fiber strand are conveyed in a generally flat adjacent arrangement to a presenting edge of said fiber conveying channel;

wherein said fiber guiding surface extends along a first plane to a diverting point, and from said diverting point to said presenting edge, said fiber guiding surface extends at a downward angle towards said inlet opening such that free ends of the staple fibers conveyed in the flat arrangement along said fiber guiding surface are caused to protrude as a result of the deviation in said fiber guiding surface; and wherein said presenting edge comprises a generally concave trough shape.

10. A device for producing a spun thread from a strand of staple fibers, comprising:

a spindle having a yarn guiding channel defined therethrough and an inlet opening to said yarn guiding channel;

a fluid device disposed relative to said inlet so as to generate a fluid turbulence around said inlet opening;

a fiber guiding element disposed so as to deliver the strand of staple fibers to said inlet opening, said fiber guiding element comprising a fiber conveying channel with a bottom fiber guiding surface along which the staple fibers of the fiber strand are conveyed in a generally flat adjacent arrangement to a presenting edge of said fiber conveying channel;

wherein said fiber guiding surface extends along a first plane to a diverting point, and from said diverting point to said presenting edge, said fiber guiding surface extends at a downward angle towards said inlet opening such that free ends of the staple fibers conveyed in the flat arrangement along said fiber guiding surface are caused to protrude as a result of the deviation in said fiber guiding surface; and wherein said presenting edge is defined by a front surface extending generally perpendicular to an axis of said yarn guide channel.

11. A device for producing a spun thread from a strand of staple fibers, comprising:

a spindle having a yarn guiding channel defined therethrough and an inlet opening to said yarn guiding channel;

a fluid device disposed relative to said inlet so as to generate a fluid turbulence around said inlet opening;

a fiber guiding element disposed so as to deliver the strand of staple fibers to said inlet opening, said fiber guiding element comprising a fiber conveying channel with a bottom fiber guiding surface along which the staple fibers of the fiber strand are conveyed in a generally flat adjacent arrangement to a presenting edge of said fiber conveying channel;

wherein said fiber guiding surface extends along a first plane to a diverting point, and from said diverting point to said presenting edge, said fiber guiding surface extends at a downward angle towards said inlet opening such that free ends of the staple fibers conveyed in the flat arrangement along said fiber guiding surface are caused to protrude as a result of the deviation in said fiber guiding surface; and wherein said presenting edge is defined by a front surface extending in a transverse curve with respect to an axis of said yarn guiding channel.

12. A device for producing a spun thread from a strand of staple fibers, comprising:

a spindle having a yarn guiding channel defined therethrough and an inlet opening to said yarn guiding channel;

a fluid device disposed relative to said inlet so as to generate a fluid turbulence around said inlet opening;

a fiber guiding element disposed so as to deliver the strand of staple fibers to said inlet opening, said fiber guiding element comprising a fiber conveying channel with a bottom fiber guiding surface along which the staple fibers of the fiber strand are conveyed in a generally flat adjacent arrangement to a presenting edge of said fiber conveying channel;

wherein said fiber guiding surface extends along a first plane to a diverting point, and from said diverting point to said presenting edge, said fiber guiding surface extends at a downward angle towards said inlet opening such that free ends of the staple fibers conveyed in the flat arrangement along said fiber guiding surface are caused to protrude as a result of the deviation in said fiber guiding surface; and wherein said presenting edge is disposed at a horizontal distance from said inlet opening of from about 0.1 mm to about 1 mm.

13. A device for producing a spun thread from a strand of staple fibers, comprising:

a spindle having a yarn guiding channel defined therethrough and an inlet opening to said yarn guiding channel;

a fluid device disposed relative to said inlet so as to generate a fluid turbulence around said inlet opening;

a fiber guiding element disposed so as to deliver the strand of staple fibers to said inlet opening, said fiber guiding element comprising a fiber conveying channel with a bottom fiber guiding surface along which the staple fibers of the fiber strand are conveyed in a generally flat adjacent arrangement to a presenting edge of said fiber conveying channel;

wherein said fiber guiding surface extends along a first plane to a diverting point, and from said diverting point to said presenting edge, said fiber guiding surface extends at a downward angle towards said inlet opening such that free ends of the staple fibers conveyed in the flat arrangement along said fiber guiding surface are caused to protrude as a result of the deviation in said fiber guiding surface; and wherein said presenting edge is disposed at a vertical distance from a centerline axis of said yarn guiding channel of between about 10% to about 40% of a diameter of said yarn guiding channel.

* * * * *